US010934650B2

(12) United States Patent
Marijsse et al.

(10) Patent No.: US 10,934,650 B2
(45) Date of Patent: Mar. 2, 2021

(54) METHOD OF PREPARING A TUFTING PROCESS FOR TUFTING A FABRIC, IN PARTICULAR CARPET

(71) Applicant: Vandewiele NV, Kortrijk/Marke (BE)

(72) Inventors: Frank Marijsse, Kortrijk/Marke (BE); Bram Vanderjeugt, Ypres (BE)

(73) Assignee: VANDEWIELE NV, Kortrijk/Marke (BE)

( * ) Notice: Subject to any disclaimer, the term of this patent is extended or adjusted under 35 U.S.C. 154(b) by 50 days.

(21) Appl. No.: 16/339,524

(22) PCT Filed: Oct. 27, 2017

(86) PCT No.: PCT/EP2017/077664
§ 371 (c)(1),
(2) Date: Apr. 4, 2019

(87) PCT Pub. No.: WO2018/083042
PCT Pub. Date: May 11, 2018

(65) Prior Publication Data

US 2019/0264360 A1 Aug. 29, 2019

(30) Foreign Application Priority Data

Nov. 4, 2016 (EP) ..... 16197302

(51) Int. Cl.
*D05C 15/32* (2006.01)
*D05C 15/26* (2006.01)

(52) U.S. Cl.
CPC ..... *D05C 15/32* (2013.01); *D05C 15/26* (2013.01)

(58) Field of Classification Search
CPC . D05C 15/04; D05C 5/26; D05C 5/32; D05C 5/34; D05C 5/02
See application file for complete search history.

(56) References Cited

U.S. PATENT DOCUMENTS 6,244,203 B1 * 6/2001 Morgante ..... D05C 15/18 112/475.23
6,775,403 B1 8/2004 Ban et al.
(Continued)

FOREIGN PATENT DOCUMENTS

EP 2077348 7/2009
GB 2319786 6/1998
(Continued)

OTHER PUBLICATIONS

International Search Report filed in PCT/EP2017/077664 dated Nov. 29, 2017.

*Primary Examiner* — Nathan E Durham
(74) *Attorney, Agent, or Firm* — Rankin, Hill & Clark LLP

(57) ABSTRACT

A method of preparing a tufting process for tufting a fabric comprises the steps of: a) selecting at least one object to be shown on a tufted fabric as a three-dimensional tufting structure element (116), b) three-dimensionally scanning the at least one object for providing a set of three-dimensional scan data representing at least a portion of the three-dimensional structure of the at least one object, c) providing a set of tufting instruction data on the basis of the three-dimensional scan data, the tufting instruction data, in association with the at least one three-dimensional tufting structure element (116) to be tufted, comprising information relating to at least one tufting aspect of the piles to be tufted for providing the at least one three-dimensional tufting structure element (116).

9 Claims, 2 Drawing Sheets

(56) References Cited

U.S. PATENT DOCUMENTS

| | | | | |
|---|---|---|---|---|
| 2005/0053275 | A1 | 3/2005 | Stokes | |
| 2005/0188905 | A1 | 9/2005 | Dabrowa | |
| 2006/0003111 | A1 | 1/2006 | Tseng | |
| 2009/0260554 | A1 | 10/2009 | Hall | |
| 2016/0038804 | A1* | 2/2016 | Burns ..... | A63B 59/20<br>473/513 |

FOREIGN PATENT DOCUMENTS

| | | |
|---|---|---|
| GB | 2357519 | 6/2001 |
| GB | 2393454 | 3/2004 |

* cited by examiner

126

128

| | | | | | | | | | | |
|---|---|---|---|---|---|---|---|---|---|---|
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |
| 1 | 1 | 1 | 1 | 1 | 20 | 20 | 20 | 20 | 20 | 20 |

118

120'

Fig. 3

126

128

132

| | | | | | | | | | | |
|---|---|---|---|---|---|---|---|---|---|---|
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |
| 20 | 20 | 20 | 20 | 20 | 19 | 18 | 17 | 16 | 15 | 14 |

120'

122'

Fig. 4

METHOD OF PREPARING A TUFTING PROCESS FOR TUFTING A FABRIC, IN PARTICULAR CARPET

The present invention relates to a method of preparing a tufting process for tufting a fabric, for example, a carpet.

When tufting a fabric, for example, a carpet, a three-dimensional surface structure of such a fabric can be obtained by providing a variation of the pile height. This can, for example, be done for emphasizing the optical appearance of particular regions of such a fabric by providing such regions with piles of increased pile height.

It is an object of the present invention to provide a method of preparing a tufting process for tufting a fabric, in particular a carpet, allowing the generation of a complex three-dimensional surface structure of a fabric to be tufted.

According to the present invention, this object is achieved by a method of preparing a tufting process for tufting a fabric, comprising the steps of:

a) selecting at least one object to be shown on a tufted fabric as a three-dimensional tufting structure element,
b) three-dimensionally scanning the at least one object for providing a set of three-dimensional scan data representing at least a portion of the three-dimensional structure of the at least one object,
c) providing a set of tufting instruction data on the basis of the three-dimensional scan data, the tufting instruction data, in association with the at least one three-dimensional tufting structure element to be tufted, comprising information relating to at least one tufting aspect of the piles to be tufted for providing the at least one three-dimensional tufting structure element.

According to the principle of the present invention, the data containing the information relating to the three-dimensional surface structure of a fabric to be tufted are generated on the basis of a set of data directly reflecting the three-dimensional structure of an object to be shown on the fabric as a three-dimensional tufting structure element. Due to providing these data reflecting the three-dimensional structure of such an object by carrying out a three-dimensional scanning process, a time-consuming and complex procedure for manually defining, for example, the pile height of each single pile to be tufted for generating the three-dimensional structure element can be avoided.

It is to be noted that, according to the principles of this invention, an "object" can be an entire subject or constructional element, like an automobile, or can be a part thereof.

For example, the pile height may be such a tufting aspect of the piles to be tufted. Of course, other tufting aspects, for example, the pile type of a particular pile to be tufted may be used alternatively or additionally.

For providing information relating to the entire fabric to be tufted, it is proposed that the tufting instruction data, in association with each pile of the fabric to be tufted, comprise information relating to at least one tufting aspect.

For providing clear information relating to the piles to be tufted, a pattern representation representative of the fabric to be tufted may be provided, the pattern representation comprising the at least one three-dimensional tufting structure element. For example, in association with the pattern representation, a pixel grid may be defined comprising a plurality of pixels following each other in a first direction corresponding to a tufting working direction and a second direction substantially perpendicular with respect to the first direction, each pixel representing one pile of the fabric to be tufted, wherein, at least in association with the at least one three-dimensional tufting structure element, the tufting instruction data, in association with each pixel of the pixel grid, comprise information relating to the at least one tufting aspect.

For enhancing the optical appearance of a fabric to be tufted and emphasizing the three-dimensional structure effect generated by a varying tufting aspect, for example, a varying pile height, a color representation representative of the color appearance of the object may be provided, and the tufting instruction data may be provided on the basis of the color representation. Therefore, the pile color may be used as a further tufting aspect.

When additionally using the pile color as one of the tufting aspects defining a particular pile, at least in association with the at least one three-dimensional tufting structure element, the tufting instruction data, in association with each pixel of the pixel grid, may comprise information relating to the pile color.

The method may further comprise the step of generating a tufting machine control file on the basis of the tufting instruction data.

According to a further aspect, the invention relates to a method of tufting a fabric, comprising the steps of:

generating a tufting machine control file by using the method of preparing a tufting process according to the invention,
forwarding the tufting machine control file to a tufting machine selected for carrying out the tufting process,
operating the tufting machine on the basis of the tufting machine control file.

The present invention will now be explained with reference to the attached drawings, in which:

FIG. 3 shows a part of a pixel grid corresponding to area III of FIG. 2;

FIG. 4 shows a part of a pixel grid corresponding to area IV of FIG. 2.

Figure 1:
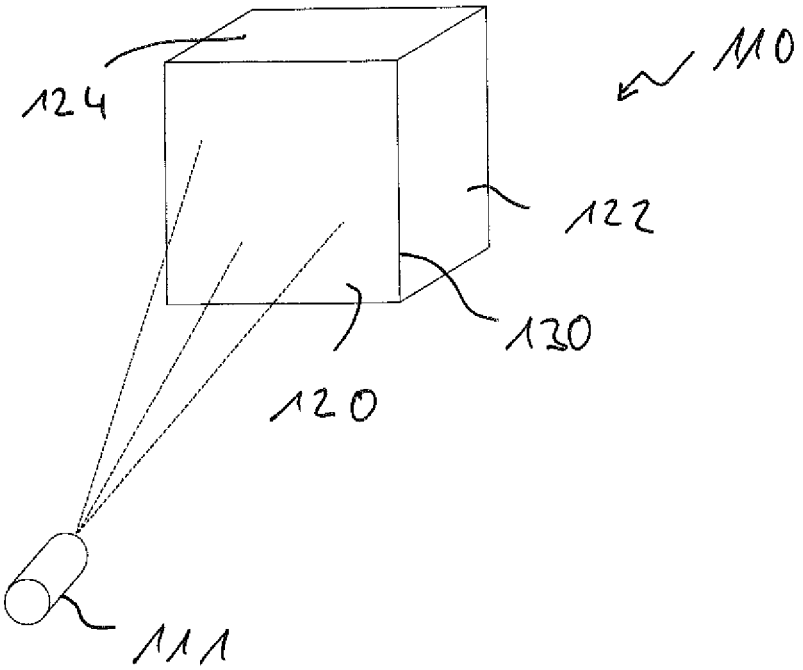
FIG. 1 is a drawing showing the step of three-dimensionally scanning an object.

In FIG. 1, an object 110 is shown which, in the context of the following explanation of the present invention, is to be used as an object to be shown on the surface of a tufted fabric, for example, a carpet, as a three-dimensional surface structure element. While, in FIG. 1, object 110 is depicted as being a cube, it is obvious that the present invention can be used in combination with any three-dimensional object, for example, a house, a tree, an automobile, etc., or a part or a detail with a specific surface structure thereof. After having selected such an object 110 as an object which is to be shown on a tufted fabric as a three-dimensional tufting structure element, a 3D scanning process by the use of a 3D scanning device 111 is carried out for providing a set of three-dimensional scan data representing the three-dimensional structure of object 110. This, for example, can be done by moving 3D scanning device 111 to different locations for viewing object 110 from different directions, by moving 3D scanning device 111 around object 110, or by positioning this 3D scanning device 111 at a particular location allowing the generation of three-dimensional scan data of object 110 representative of the three-dimensional character of object 110 which is to be shown on the fabric to be tufted. If, for example, the perspective view of object 110 shown in FIG. 1 is to be provided as a three-dimensional tufting structure element on a tufted fabric, for example, carpet, viewing object 110 from this side may be sufficient, while data provided by viewing object 110 from the back side may not be necessary.

On the basis of the three-dimensional scan data provided by three-dimensionally scanning object 110, a set of tufting instruction data can be provided reflecting the three-dimensional character of object 110. This will be explained in the following with reference to FIGS. 2 to 4. It is to be noted that the data processing of the three-dimensional scan data can be carried out by one or a plurality of data processing means, for example, comprising a programmed microprocessor, receiving the scan data for generating the tufting instruction data and finally generating a tufting machine control file for inputting into a tufting machine and tufting a fabric on the basis of this control file.

Figure 2:
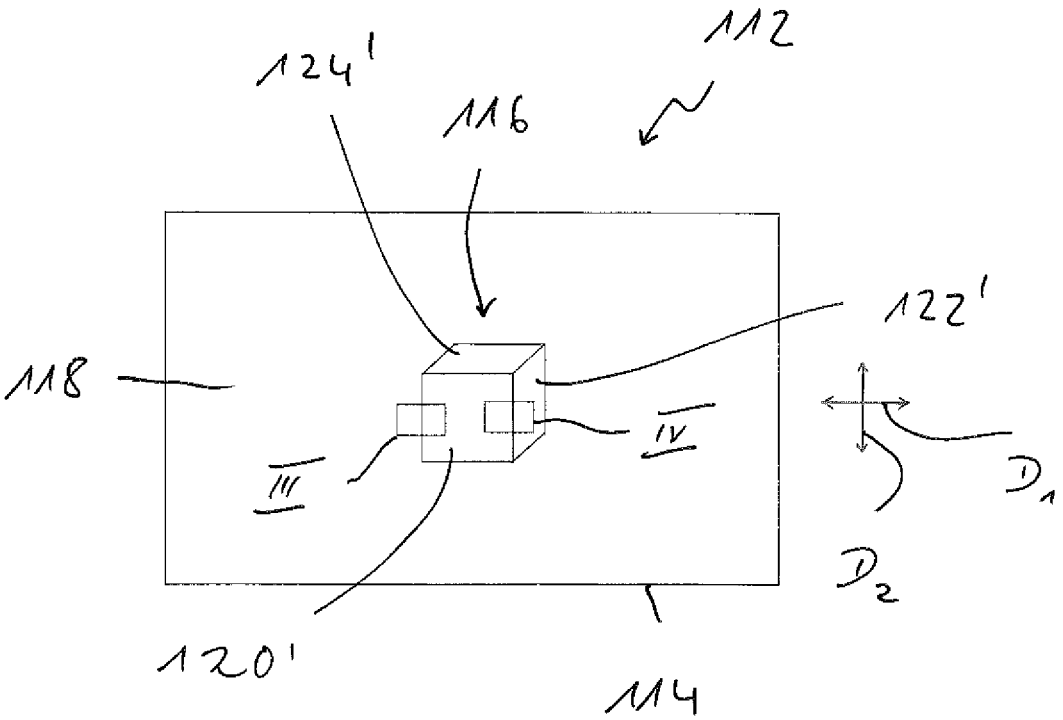
FIG. 2 shows a pattern representation of a fabric to be tufted comprising the three-dimensional object scanned according to FIG. 1 as a three-dimensional tufting structure element.

FIG. 2 shows a pattern representation 112 which may be provided as being a representation of a fabric to be tufted, for example, a carpet, showing an outline 114 corresponding to an outline of the fabric to be tufted. Pattern representation 112 shows a three-dimensional tufting structure element 116 to be provided in a tufted fabric and corresponding to object 110, for example, in a middle portion thereof. It is to be noted that, of course, a plurality of different objects may be provided as corresponding three-dimensional tufting structure elements in one and the same pattern representation 112.

In association with pattern representation 112, a pixel grid may be defined comprising a plurality of pixels, each pixel representing one pile to be tufted. For example, this pixel grid may contain lines of pixels following each other in a first direction $D_1$ corresponding to a tufting working direction, while the pixel grid may contain columns of pixels following each other in a second direction $D_2$ substantially perpendicular with respect to the first direction $D_1$ and, for example, corresponding to a longitudinal direction of a needle bar of a tufting machine. A plurality of needles is provided on such a needle bar following each other in the second direction $D_2$. A yarn is threaded through each needle of the needle bar such that, by means of each such needle and the yarn threaded therethrough, respectively, a row of piles, corresponding to a line in the pixel grid, can be tufted. It is to be noted that, in a tufting machine having a sliding needle bar, one row of piles can be tufted by using different needles, for example, having differently colored yarns threaded therethrough such that rows of piles following each other in the tufting working direction corresponding to direction $D_1$ and having different colors can be tufted.

The tufting instruction data, in association with each such pixel of a pixel grid and each pile to be tufted, respectively, contain information relating to at least one tufting aspect. If a fabric showing a three-dimensional surface structure is to be tufted, the pile height can be used as one such tufting aspect. When using a tufting machine having a sliding needle bar, the pile color can be used as a further tufting aspect.

Based on the three-dimensional scan data, the tufting instruction data are provided such as to reflect the three-dimensional structure of object 110 within the three-dimensional tufting structure element 116. For example, the structure of the three-dimensional scan data may be such as to indicate the positioning of respective areas of the scanned object within the space and/or relative to each other. In an alternative example, such a relative positioning of particular areas of the scanned object may be determined or calculated on the basis of the scan data.

When tufting a fabric on the basis of pattern representation 112 shown in FIG. 2, in an area 118 surrounding tufting structure element 116, for example, a predetermined pile height can be set as a default value. If the tufting machine used for carrying out the tufting process, for example, is arranged such as to provide piles of twenty different pile heights, a number "1" may represent a pile having the minimum pile height, while a number "20" may represent a pile having a maximum pile height. In pattern representation 112 shown in FIG. 2, the minimum pile height "1" may be associated with area 118 surrounding tufting structure element 116.

Based on the three-dimensional scan data, in association with each pixel of the pixel grid within the area covered by tufting structure element 116, the pile height can be determined. For example, in association with those portions of object 110 and tufting structure element 116, respectively, representing the most raised areas which, when looking at three-dimensional object 110, are those areas which are closest to a virtual viewer, the maximum pile height "20" may be used, while, in association with those portions which, relative to area 118, are the least raised areas and therefore, when looking at three-dimensional object 110, are those areas positioned with the biggest or the maximum distance to a virtual viewer, the minimum pile height "1" or a slightly increased pile height may be used. As, in a perspective view of object 110 which is to be provided as a three-dimensional tufting structure element in the fabric to be tufted, a front face 120 of object 110 corresponds to the most raised portion of the three-dimensional tufting structure element 116, pile height "20" may be associated with this front face 120 and a corresponding portion 120' of tufting structure element 116. A side face 122 of object 110 is inclined with respect to front face 120 such that a corresponding area 122' of tufting structure element 116 will have a varying pile height decreasing from the maximum pile height "20". The same is true for an area 124' corresponding to a top face 124 of object 110. Once more, it is to be noted that associating a particular pile height representing a tufting aspect to a particular set of tufting instruction data is carried out by a data processing means on the basis of the information contained in the scan data and representing the relative positioning of portions of a scanned object with respect to each other and with respect to a virtual viewer, respectively.

FIGS. 3 and 4 show parts of a pixel grid 126 associated with pattern representation 112 in which each pixel 128 corresponds to a pile to be tufted. Therefore, in association with each such pixel, the tufting instruction data contain information about at least one tufting aspect, for example, the pile height of a pile to be tufted.

FIG. 3 shows the transition from area 118 surrounding tufting structure element 116 to area 120' representing the most raised area of tufting structure element 116. Therefore, as indicated above, pile height "20" will be associated with each pixel 128 of the pixel grid 126 contained within this area 120'. As, in area 118 as well as in area 120', no variation of the pile height is to occur, in association with each pixel and therefore in association with each pile to be tufted in these areas, uniform pile heights "1" and "20", respectively, will be selected in association with the tufting aspect "pile height" and therefore will be reflected in the tufting instruction data.

FIG. 4 shows the transition between area 120' and area 122' of tufting structure element 116. Due to the fact that area 122' represents side face 122 which is inclined with respect to front face 120 and which, therefore, in a perspective view, starting out from an edge 130, has an increasing distance to front face 120, the pile height in area 122' decreases starting out from a line 132 indicating the transition between areas 120' and 122'. In FIG. 4, this decrease of the pile height is reflected by the decreasing numbers representing the pile height within each pixel 128 of area 122'.

Normally, object 110 will have an extension between the most rear portion thereof and the most forward portion thereof which is substantially larger than the difference between the maximum pile height and the minimum pile height. Therefore, when transforming the three-dimensional scan data into the tufting instruction data representing the pile height, a mathematical scaling operation may be carried out for transforming the extension of object 110 between its most forward portion and its most rearward portion to an extension corresponding to the maximum difference between the maximum pile height and the minimum pile height used for generating the varying pile height of tufting structure element 116.

In addition to the information relating to the pile height, the tufting instruction data may contain information relating to the pile color as a further tufting aspect. For example, a photograph can be taken of object 110 and can be used as a color representation. In association with each pixel within tufting structure element 116, a particular color corresponding to the predominant color of a corresponding area of this color representation can be used for defining a particular pile color. Of course, the number of available pile colors is limited, even if a tufting machine having a sliding needle bar is used. This information relating to the pile color may be superimposed to the information relating to the pile height and, therefore, the three-dimensional structure effect generated by piles of different heights can be emphasized by a color variation which may resemble the color variation of object 110 when viewed from a particular direction.

After having defined such a set of tufting instruction data, a tufting machine control file is generated on the basis of these data. This tufting machine control file is input into the tufting machine and the tufting machine is operated on the basis of this tufting machine control file which translates the information contained in the tufting instruction data into commands for operating a tufting machine. The fabric tufted on 30 the basis of such a tufting machine control file will have the appearance depicted in a pattern representation having a three-dimensional tufting structure element in the middle thereof, showing a raised area 120' of uniform pile height projecting beyond a face defined by the piles of reduced uniform height present in area 118. Additionally, this three-dimensional tufting structure element will have two areas corresponding to areas 122' and 124' shown in the pattern representation 112 and having piles of decreasing pile height starting out from the maximum pile height provided in area 120'.

As stated above, a plurality of different tufting structure elements may be provided within one and the same tufted fabric by selecting correspondingly different objects, scanning these objects for providing three-dimensional scan data and, in association with each such object and the corresponding three-dimensional tufting structure element, providing tufting instruction data reflecting at least the pile height as one tufting aspect for providing a three-dimensional structure.

When starting out from the set of data corresponding to the three-dimensional scan data which, for example, may be provided such as to represent the entire three-dimensional structure of a scanned object, these data and the scanned object, respectively, can be depicted on a monitor by commonly known software. By turning the object, the viewing angle can be changed and the view corresponding to the view which is to be depicted on a carpet may be selected and the tufting instruction data may be generated on the basis of such a particular selected perspective view of the three-dimensionally scanned object.

The invention claimed is:

1. A method of preparing a tufting process for tufting a fabric, comprising:

a) selecting at least one object to be shown on a tufted fabric as a three-dimensional tufting structure element, b) three-dimensionally scanning the at least one object for providing a set of three-dimensional scan data representing at least a portion of a three-dimensional structure of the at least one object, and c) providing a set of tufting instruction data based on the three-dimensional scan data, the tufting instruction data, in association with the at least one three-dimensional tufting structure element to be tufted, comprising information relating to at least one tufting aspect of piles of the fabric to be tufted for providing the at least one three-dimensional tufting structure element;

wherein the tufting instruction data, in association with each of the piles of the fabric to be tufted, comprise information relating to the at least one tufting aspect, the at least one tufting aspect including a pile height of the piles to be tufted; and wherein the three-dimensional scan data is transformed into the tufting instruction data representing the pile height using a mathematical scaling operation to transform an extension of the at least one object between its most forward portion and its most rearward portion to an extension corresponding to a maximum difference between a maximum pile height and a minimum pile height used for generating a varying pile height of the at least one three-dimensional tufting structure element.

2. The method according to claim 1, wherein the at least one tufting aspect includes a pile type of the piles to be tufted.

3. The method according to claim 1, wherein a pattern representation representative of the fabric to be tufted is provided, the pattern representation representing the at least one three-dimensional tufting structure element.

4. The method according to claim 3, wherein, in association with the pattern representation, a pixel grid is defined comprising a plurality of pixels following each other in a first direction corresponding to a tufting working direction and a second direction substantially perpendicular with respect to the first direction, each pixel of the plurality of pixels representing one of the piles of the fabric to be tufted, wherein, at least in association with the at least one three-dimensional tufting structure element, the tufting instruction data, in association with each pixel, comprise information relating to the at least one tufting aspect.

5. The method according to claim 4, wherein, at least in association with the at least one three-dimensional tufting structure element, the tufting instruction data, in association with each pixel, comprise information relating to a pile color.

6. The method according to claim 1, wherein a color representation representative of a color appearance of the object is provided, and wherein the tufting instruction data are provided on the basis of the color representation.

7. The method according to claim 6, wherein the at least one tufting aspect includes a pile color.

8. The method according to claim 1, further comprising generating a tufting machine control file on the basis of the tufting instruction data.

9. A method of tufting a fabric, comprising:

generating a tufting machine control file by using the method of claim 1, including by:

a) selecting at least one object to be shown on a tufted fabric as a three-dimensional tufting structure element, b) three-dimensionally scanning the at least one object for providing a set of three-dimensional scan data representing at least a portion of a three-dimensional structure of the at least one object, and c) providing a set of tufting instruction data based on the three-dimensional scan data, the tufting instruction data, in association with the at least one three-dimensional tufting structure element to be tufted, comprising information relating to at least one tufting aspect of piles of the fabric to be tufted for providing the at least one three-dimensional tufting structure element;

wherein the tufting instruction data, in association with each of the piles of the fabric to be tufted, comprise information relating to the at least one tufting aspect, the at least one tufting aspect including a pile height of the piles to be tufted; and wherein the three-dimensional scan data is transformed into the tufting instruction data representing the pile height using a mathematical scaling operation to transform an extension of the at least one object between its most forward portion and its most rearward portion to an extension corresponding to a maximum difference between a maximum pile height and a minimum pile height used for generating a varying pile height of the at least one three-dimensional tufting structure element; and forwarding the tufting machine control file to a tufting machine selected for carrying out the tufting process, operating the tufting machine on the basis of the tufting machine control file.

* * * * *